US005477709A

United States Patent [19]

Rowe

[11] Patent Number: 5,477,709

[45] Date of Patent: Dec. 26, 1995

[54] LOCKING ASSEMBLY FOR SECURING AND SEALING SPOOLS TO A SPINDLE DURING A DYEING OPERATION

[75] Inventor: Gregory A. Rowe, Chocowinity, N.C.

[73] Assignee: Mid-Atlantic Tool & Die, Inc., Washington, N.C.

[21] Appl. No.: 202,561

[22] Filed: Feb. 28, 1994

[51] Int. Cl.[6] ..... D06B 5/18; D06B 23/00

[52] U.S. Cl. ..... 68/212; 68/198; 242/597.4

[58] Field of Search ..... 68/212, 189, 198; 118/597.4, 118.41

[56] References Cited

U.S. PATENT DOCUMENTS

| | | | |
|---|---|---|---|
| 1,507,839 | 9/1924 | LaFayette | 68/198 |
| 1,933,980 | 4/1933 | Hornbuckle et al. | 68/189 |
| 2,835,124 | 5/1958 | Jackson | 68/198 |
| 3,252,667 | 5/1966 | Miller | 242/597.4 X |
| 3,481,165 | 12/1969 | Tigges | 68/198 |
| 3,512,731 | 5/1970 | Kitamura | 242/130.2 |
| 3,596,846 | 8/1971 | Johnston | 242/597.4 X |
| 3,731,502 | 5/1973 | Stearns et al. | 68/212 X |
| 3,777,516 | 12/1973 | Tigges | 68/198 |
| 4,423,609 | 1/1984 | Itoh | 68/212 |
| 4,646,546 | 3/1987 | Smith | 68/212 |
| 4,720,986 | 1/1988 | Fuchs et al. | 68/198 |

FOREIGN PATENT DOCUMENTS

| | | | |
|---|---|---|---|
| 0279009 | 8/1988 | European Pat. Off. | 68/212 |
| 1962576 | 6/1971 | Germany | 68/198 |
| 2039097 | 2/1972 | Germany | 68/212 |
| 2456517 | 8/1976 | Germany | 68/198 |
| 2558440 | 6/1977 | Germany | 68/212 |
| 649591 | 11/1962 | Italy | 68/198 |
| 1030862 | 5/1966 | United Kingdom | 242/597.4 |

*Primary Examiner*—Philip R. Coe

*Attorney, Agent, or Firm*—Sughrue, Mion, Zinn, Macpeak & Seas

[57] ABSTRACT

A locking assembly for securing spools of fibrous material on a spindle during a pressurized dyeing operation. The locking assembly has jaws which, when in a locked position, engage with the spindle to secure the spools thereon. An actuator moves the jaws to a released position for removal of the spools. A tapered surface of the jaws cooperates with the spindle to allow the locking assembly to be placed on the spindle without the need for manually setting the jaws in a released state.

18 Claims, 6 Drawing Sheets

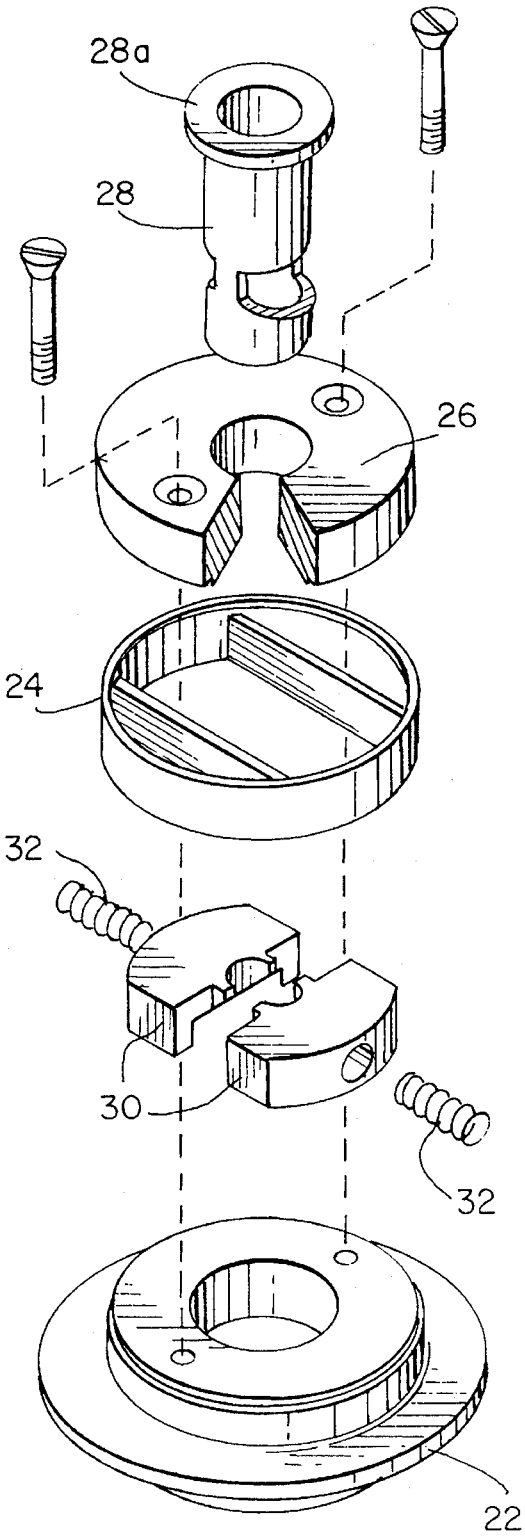
FIG. 2
FIG. 1
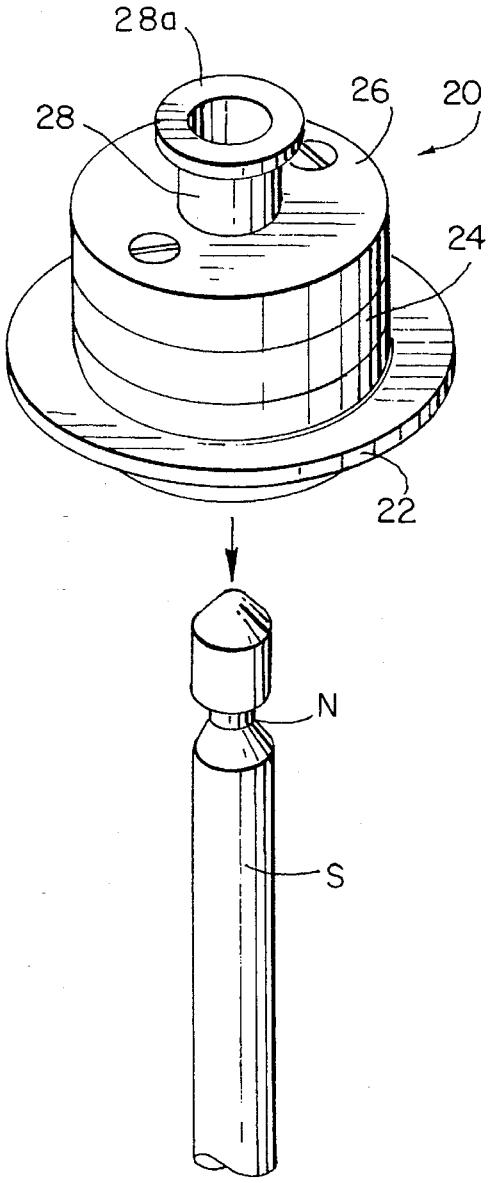

FIG.4
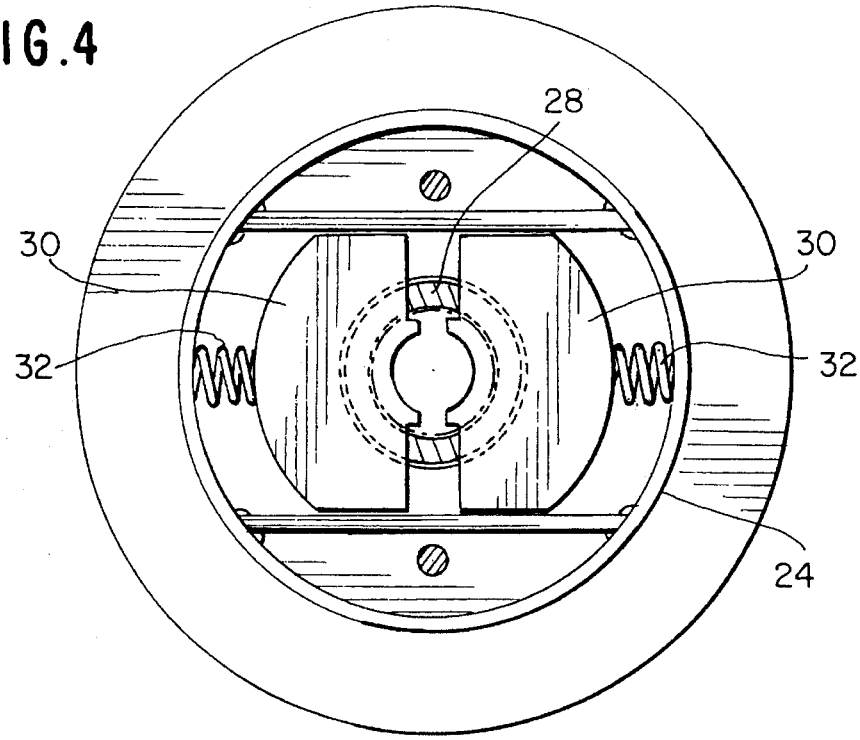
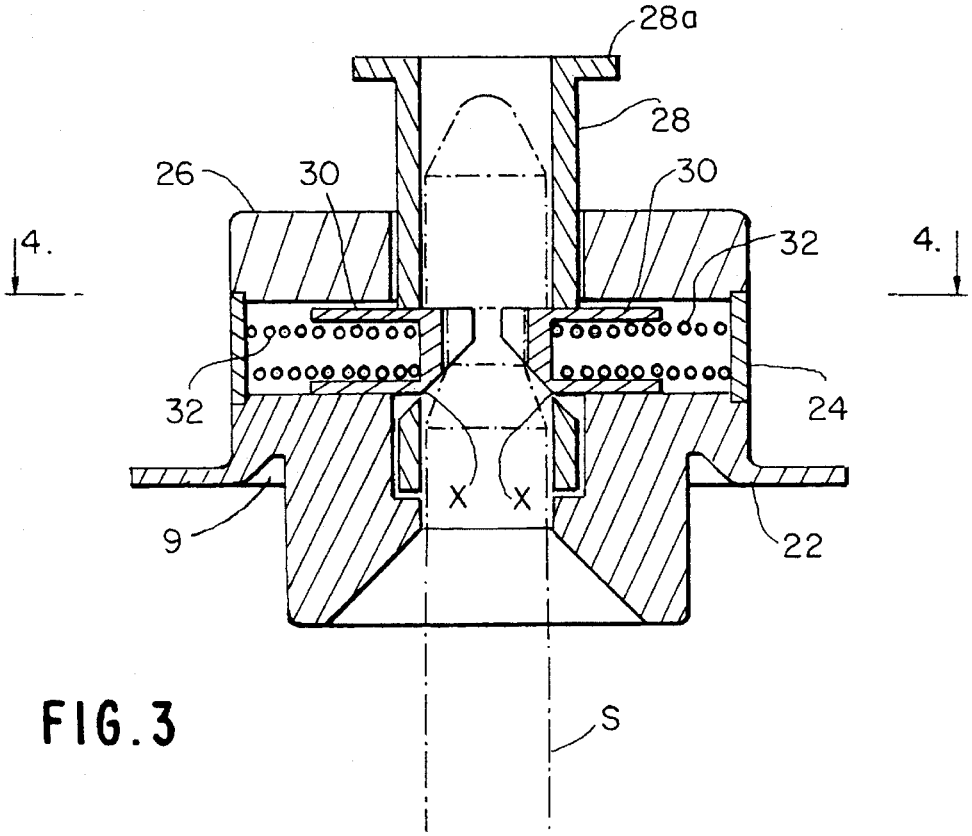
FIG.3

FIG. 6
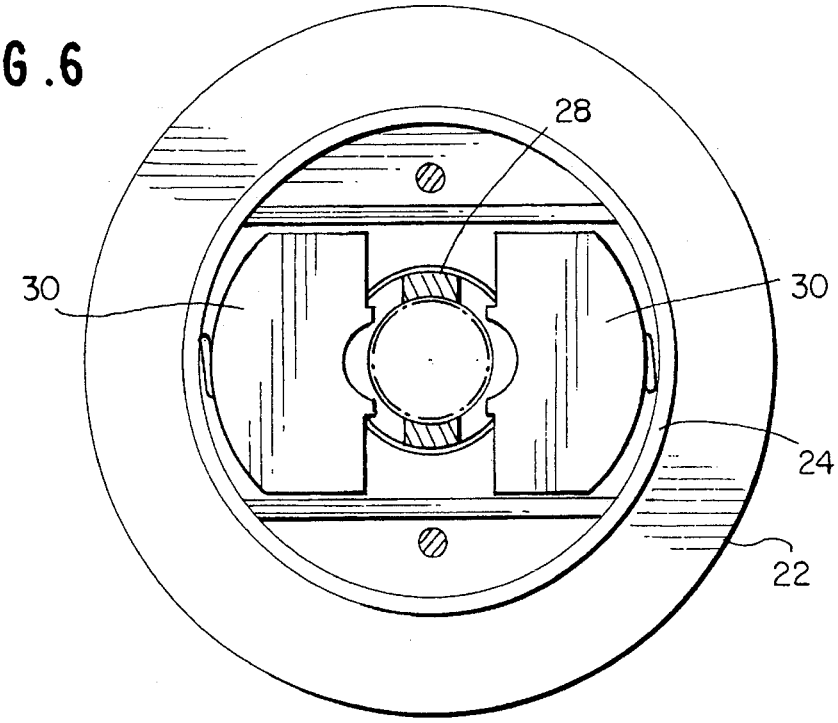
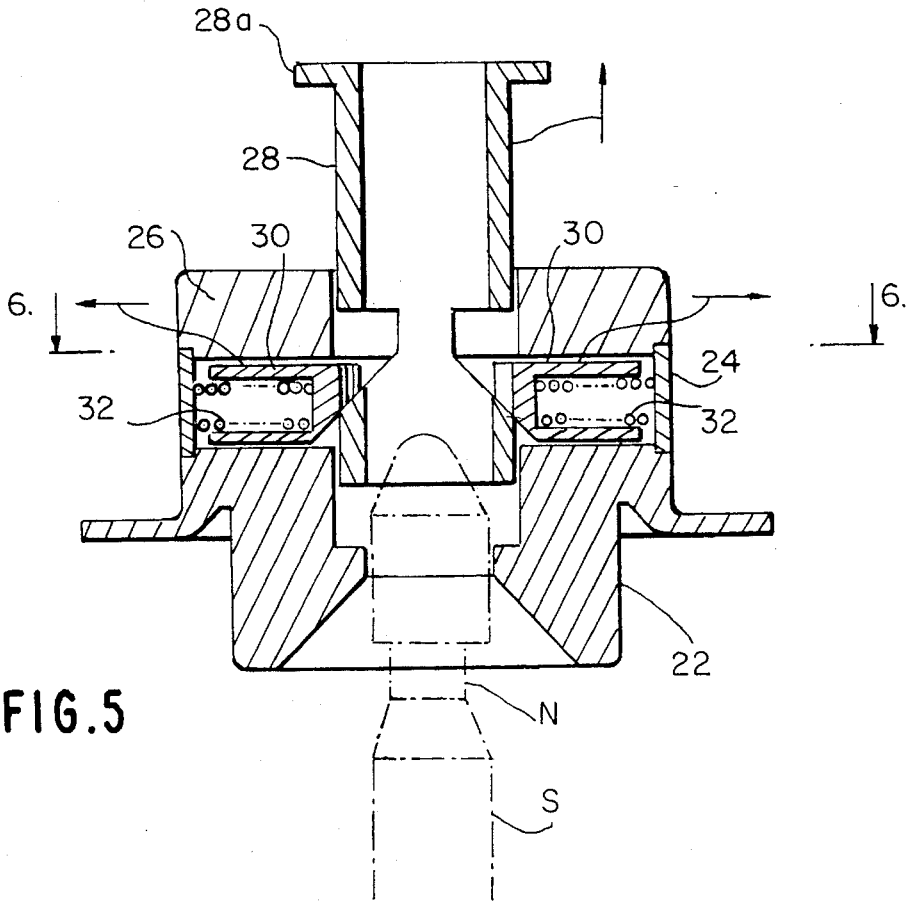
FIG. 5

FIG. 13
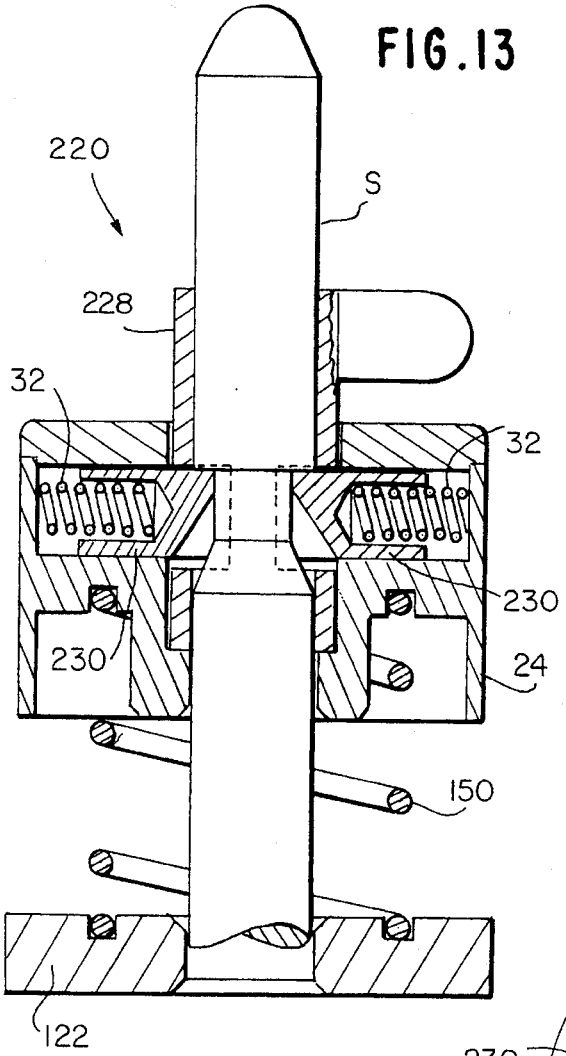
FIG. 14
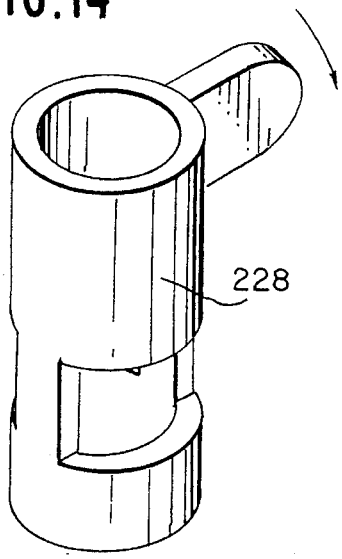
FIG. 16
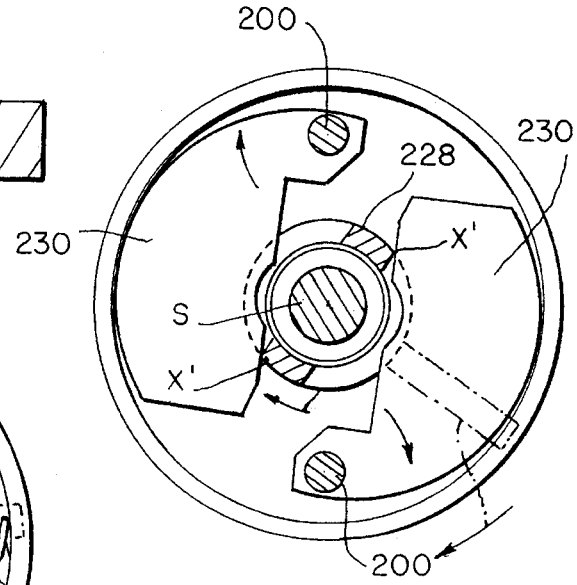
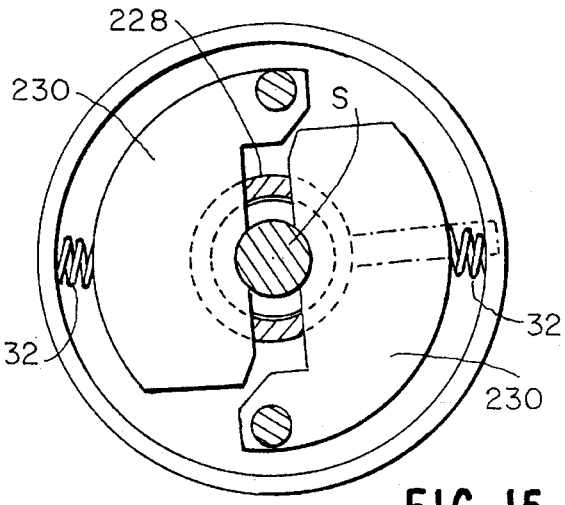
FIG. 15

LOCKING ASSEMBLY FOR SECURING AND SEALING SPOOLS TO A SPINDLE DURING A DYEING OPERATION

BACKGROUND OF THE INVENTION

1. Field of the Invention

The subject invention relates to a locking assembly for securing and sealing a spool of yarn, or the like, to a spindle. More particularly, the invention is an assembly which reliably secures a spool to a spindle during a dyeing operation and can be easily locked in place with respect to the spindle or removed from the spindle.

2. Description of the Related Art

In order to dye yarn or other extended fibrous materials, it is well known to submerge multiple spools of the material into dye kettles. The spools are placed on cylindrical dye tubes which are mounted on spindles which extend vertically in the dye kettle. After being loaded onto the spindles, the spools of yarn are compressed and held in place by a locking device commonly known as a "locknut". The dye tubes are hollow cylinders having a plurality of holes formed therein. The spindles are hollow or solid rods which may be threaded or notched at regular intervals.

The locknut holds the spools in a compressed state and also provides a seal over a top portion of the associated dye tube. Dye is then pumped through a lower portion of the dye tube at high pressure and thus is forced through the holes in the dye tube and into the spool of material at a high pressure. This allows the dye to permeate the entire spool of material in an even manner.

Recently it has become desirable to compress the spools to a higher degree to optimize the amount of material that can be dyed in a single operation. This requires that the dye be injected at a higher pressure. Accordingly, locknuts must provide a high degree of mechanical strength as well as a high degree of sealing with respect to the dye tube.

To provide adequate sealing, it is well known to provide separate end caps, or the like, below the locknut. These end caps are individually designed to adapt to a particular dye tube. U.S. Pat. No. 4,646,546 and U.S. Pat. No. 4,720,986 disclose examples of such devices. Also, conventional locknuts must be manually set in an unlocked position before being set on the spindle. Subsequently, such devices must be manually set to a locked position in order to secure the spools. This requires a great deal of labor and is not conducive to automation. Accordingly, conventional locknuts limit the efficiency of a dyeing process. Examples of such conventional devices are disclosed in U.S. Pat. Nos. 4,423,609, 3,731,502, and 3,481,165.

SUMMARY OF THE INVENTION

In view of the above, it is an object of the invention to provide a locking assembly for reliably securing spools to a spindle without the need for setting the locking assembly to an unlocked position before placing the locking on the spindle.

It is a further object of the invention to provide a locking assembly which is able to withstand a large force due to a high percentage of compression of the spools.

It is further an object of the invention to provide a locking assembly which can be easily adapted to use with existing spindles and dye tubes.

It is further an object of the invention to provide a locking assembly which can be easily placed on the spindle and removed therefrom manually or through automation.

In order to achieve these, and other, objects, the invention is a locking assembly which has opposing jaws. The jaws are biased towards each other and define a central area therebetween which receives the spindle. A lower surface of each jaw has a tapered portion formed thereon to allow the jaws to move away from the central area when the locking assembly is placed over the spindle. This allows the locking assembly to slip over the spindle with little force, e.g. only the force due to gravity. Also, such a design eliminates the need for manually setting the assembly into an unlocked position when it is placed over the spindle and subsequently setting the assembly to a locked position.

The jaws may be slidable in a linear manner, rotatable about an axis which is transverse to the spindle receiving axis, or twistable about an axis which is parallel to the spindle receiving axis. The biasing force merely urges the jaws against the spindle, locking is achieved through interaction between the spindle and transversely extending portions of the jaws. For example, locking can be achieved by virtue of engagement between shoulders of a notch formed in the spindle and an upper flat surface of the jaws. In the alternative, the spindle can be threaded and locking can be achieved by virtue of engagement between the spindle threads and threads formed on the jaws.

The jaws are releasable through a release mechanism which is either pulled or pivoted. Further, a housing of the assembly may be machined to provide a tight seal over any existing dye tube or an adapter may be attached to a lower portion of the housing to provide such sealing.

BRIEF DESCRIPTION OF THE DRAWINGS

FIG. 1 is a perspective view of a first preferred embodiment of the locking assembly and an associated spindle;

FIG. 2 is an exploded view, in partial section, of the first preferred embodiment;

FIG. 3 is a sectional view of the first preferred embodiment in a locked state;

FIG. 4 is a sectional view of the first preferred embodiment taken along line 4—4 of FIG. 3;

FIG. 5 is a sectional view of the first preferred embodiment in a released state;

FIG. 6 is a sectional view of the first preferred embodiment taken along line 6—6 of FIG. 5;

FIG. 13 is a sectional view of a third preferred embodiment;

FIG. 14 illustrates the actuator of the third preferred embodiment;

FIG. 15 is a top view of the jaws of the third preferred embodiment in a locked state; and FIG. 16 is a top view of the jaws of the third preferred embodiment in a released state.

DETAILED DESCRIPTION OF THE PREFERRED EMBODIMENTS

Figure 7:
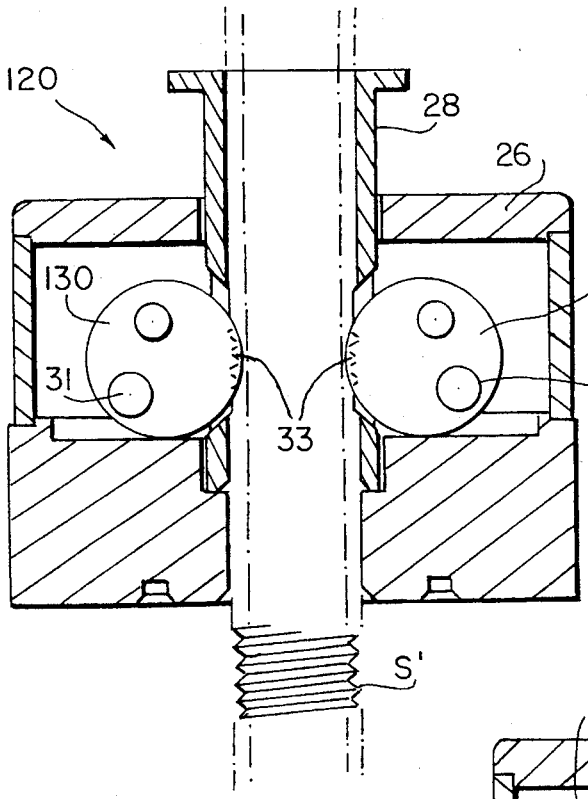
FIG. 7 is a sectional view of a second preferred embodiment in a locked state.
Figure 9:
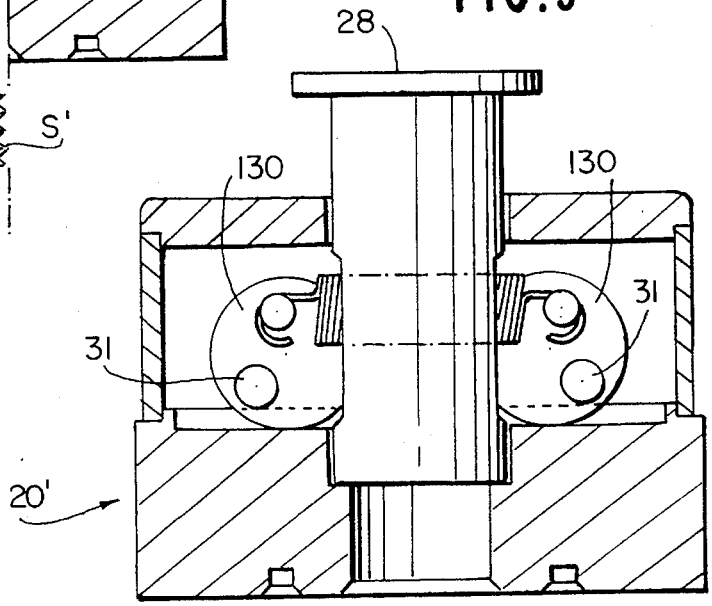
FIG. 9 illustrates the second preferred embodiment in partial section.

FIGS. 1–6 illustrate a first preferred embodiment of the invention in which jaws are slidable in the same plane. As is best illustrated in FIGS. 1 and 2, locking assembly 20 has flange member 22, guide member 24, and cover 26 which constitute a housing of locking assembly 20. Actuator 28 is slidably supported in the housing. An upper portion of actuator 28, which has rim 28*a* formed thereon, extends out of the housing. Locking assembly 20 is adapted to be slipped over spindle S and locked in position proximate notched portion N of spindle S. Of course, a dye tube (not illustrated) having spools of yarn or the like (also not illustrated) thereon is first placed on spindle S and locking assembly 20 serves to hold the spools in a compressed state while simultaneously sealing an upper end of the dye tube. As the spools shrink during a dyeing operation, locking assembly 20 moves downward due to its own weight until it abuts the top spool.

Jaws 30 are slidably mounted within the housing, within guide member 24. Springs 32 serve to bias jaws 30 respectively towards each other and towards a central portion of the housing in which spindle S is received (see FIG. 4). As is best illustrated in FIGS. 2 and 3, actuator 28 is substantially cylindrical and has two open portions formed in opposing sides thereof. Portions of jaws 30 extend respectively through these open portions. Further, the lower surfaces of jaws 30 and a lower surface which defines each of the open portions are tapered. Interaction between these tapered surfaces, at interface areas X (see FIG. 3) causes the jaws to be released from a locked position in the manner described below.

Ordinarily, jaws 30 are in the locked position illustrated in FIGS. 3 and 4. In the locked position, jaws 30 define a central area therebetween which has a radius smaller than a radius of spindle S. Accordingly, an upper surface of jaws 30 can abut against a shoulder portion defined by notch N (which is formed in spindle S) to prevent locking assembly 20 from being removed from spindle S after it has been placed thereon (see FIG. 3). However, the tapered lower surface of jaws 30 interact with spindle S when locking assembly 20 is placed on spindle S to cause jaws 30 to move outward. This interaction allows locking assembly 20 to be easily placed over spindle S. Of course, when jaws 30 reach a position corresponding to notch N, jaws 30 moved inward due to the biasing force of springs 32 to assume the locked state illustrated in FIG. 4. A plurality of notches N may be formed in spindle S and locking assembly 20 may be easily moved downward until it reaches the desired notch N. In this manner, various amounts and sizes of spools can be held in compression on spindle S.

To release jaws 30 from a locked state, in order to remove locking device 20 form spindle S after a dyeing operation, actuator 28 is merely lifted upward. Upon such lifting, interaction between the tapered surfaces of actuator 28 and jaws 30, at interface area X, causes jaws 30 to be forced outward against the force of springs 32. In this state, locking device 20 can be easily removed form spindle S (see FIGS. 5 and 6). Because this relationship between jaws 30 and actuator 28, locking assembly 20 can be easily removed from spindle S by a single upward motion. Accordingly, locking assembly 20 is readily adaptable to an automated process wherein it is removed by a robot arm or the like. Rim 28*a* facilitates grasping of actuator 28.

Jaws 30 of the first preferred embodiment have an arcuate surface which faces spindle S and a flat upper surface. This configuration allows jaws 30 to contact the shoulder portion defined by notch N over a large area. This provides a high degree of strength and thus allows for a high percentage of compression of the spools being secured to spindle S. Springs 32 need only bias jaws 30 with a relatively small force. Locking assembly 20 is held in place securely due to the large area of contact between jaws 30 and the shoulder portion of notch N. Also, groove G, or the like, can be machined into a lower surface of flange member 22 in order to allow an end of a dye tube to be received therein (see FIG. 3). This improves sealing between the dye tube and locking assembly 20 and allows locking assembly 20 to be easily adapted to use with various dye tubes and spools merely by machining the groove to the proper dimensions.

FIGS. 7–10 illustrate a second preferred embodiment of the invention. Similar elements are labeled with reference numerals which are the same as the first embodiment discussed above. Locking assembly 120 of this embodiment is similar to the embodiment above in that jaws 130 extend through openings formed in cylindrical actuator 28. Also, similar to the first embodiment, jaws 130 are biased towards each other and define a central area therebetween which receives spindle S'. However, in this embodiment, jaws 130 are pivotable about shafts 31 which are mounted in guide member 24 of the housing. Shafts 31 are transverse to an axis of spindle S' when spindle S' is received in the central area.

Figure 8:
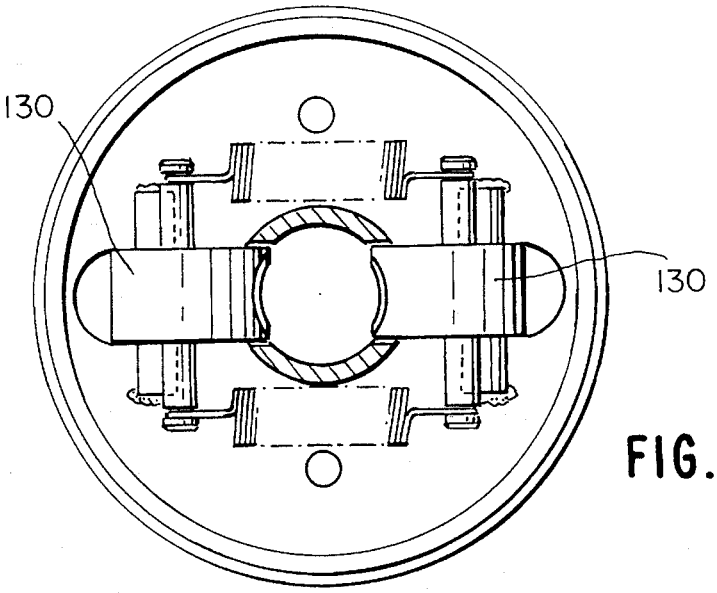
FIG. 8 is a top view of the second preferred embodiment with the cover removed.
Figure 10:
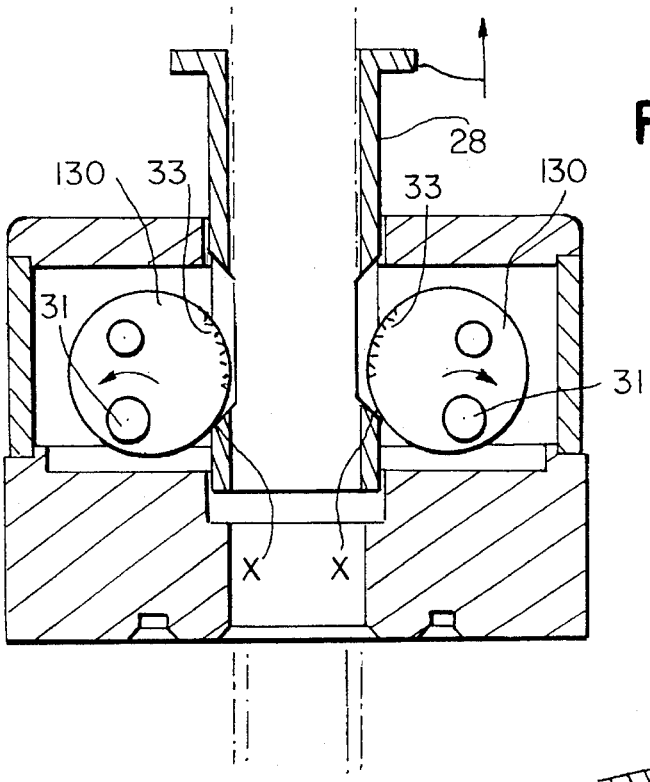
FIG. 10 illustrates the second preferred embodiment in a released state.

When actuator 28 is lifted upwards, jaws 130 pivot to an open position, due to interacting at interface area X, illustrated in FIGS. 8 and 10 wherein a central area defined therebetween is larger than the radius of spindle S'. This embodiment is adapted to be used with spindle S' which has threads formed thereon. Accordingly, jaws 130 each have threaded portion 33 formed thereon which engage with threads on spindle S' when actuator 28 is allowed to move downward and thus jaws 130 are in the locked position (see FIGS. 7 and 9).

Locking assembly 120 can be easily lowered onto spindle S' because a tapered lower surface of jaws 130 cooperate with spindle S' to cause jaws 130 to rotate to the released position when locking assembly 120 is lowered over spindle S'. Also, the position of locking assembly 120 can be adjusted merely by rotation while threaded portions 33 are engaged with threads formed on spindle S'. This allows the compression state of spools secured to spindle S' to be easily adjusted as desired. This embodiment also incorporates a slightly beveled surface 23 formed around a lower opening in flange member 22 (see FIG. 9). Beveled surface 23 serves to guide locking assembly 20 onto spindle S but, because it is formed over only a small area, presents a substantially flat surface to pressurized dye being forced through the dye tube. This configuration allows the device to have good sealing capability because the entry of dye into the opening will be minimized. Of course this feature can be used in combination with the other embodiments described herein. Other elements of this embodiment may be similar to the first embodiment.

Figure 11:
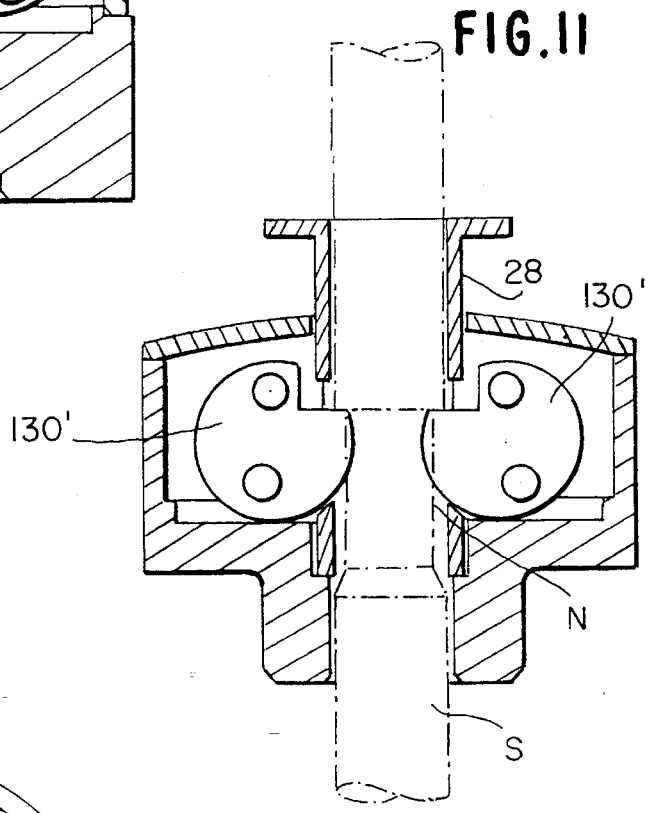
FIG. 11 illustrates a modification of the second preferred embodiment in section.
Figure 12:
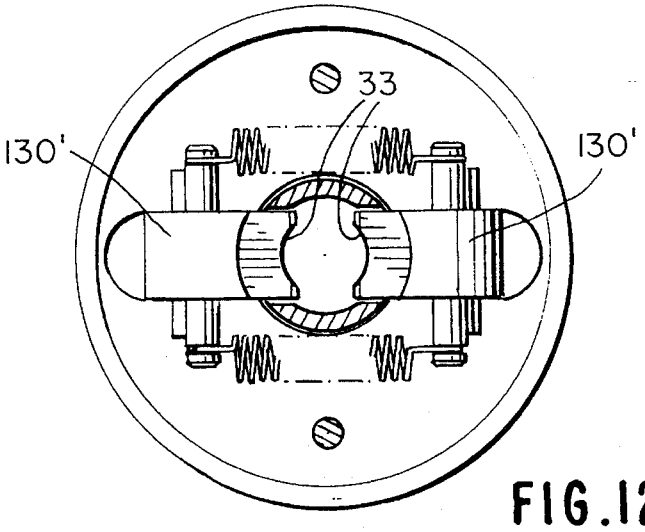
FIG. 12 is a top view of the device illustrated in FIG. 11 with the cover removed.

FIGS. 11 and 12 illustrate a modification of the second preferred embodiment which is adapted to be used with spindle S having notch N formed therein. In this embodiment, jaws 130' do not have threaded portions formed thereon. Instead, jaws 130' have a flat upper surface which opposes a shoulder portion of notch N when jaws 130' are in the locked position. Otherwise, the construction and operation of the modification illustrated in FIG. 11 is similar to the second preferred embodiment described above. A third preferred embodiment of the invention is illustrated in FIGS. 13–16. In this embodiment, locking assembly 220 has jaws 230 that pivot, or twist, about a shaft which is parallel to the axis of spindle S received in a central area defined between jaws 230. As seen in FIGS. 14 and 15, jaws 230 pivot about shafts 200 and are biased towards a central area by springs 32. Actuator 228 is substantially cylindrical and has openings formed therein through which a portion of jaws 230 extend. In a locked state, jaws 230 engage with surfaces on spindle S which define notch N to prevent locking assembly 220 from moving upward on spindle S in a manner similar to the embodiments discussed above (see FIGS. 13 and 15). When actuator 228 is rotated about its longitudinal axis, i.e. in the direction of the arrow in FIGS. 14 and 16, edges of the openings interact with jaws 230, at interface area X', to cause jaws 230 to twist outward, away from the central area to be in a released state wherein jaws 230 are not received in notch N of spindle S (see FIG. 16).

Further, the third embodiment has flange member 122 which is mounted to guide member 24 by virtue of compression spring 150. Compression spring 150 cause flange member 122 to resiliently press against the top of a dye tube which is disposed on spindle S when locking assembly 220 is locked on spindle S. A recessed portion can be formed on flange member 122 to receive an upper edge of the dye tube and ensure adequate sealing and positioning of the dye tube. Of course, this arrangement, wherein flange member 122 is supported by compression spring 150, can be adapted to the first and second preferred embodiments. Conversely, the third preferred embodiment can utilize an integral flange member 22 similar to that of the first and second embodiments.

Also, the third preferred embodiment has cap 300 which covers an upper opening of actuator 228. Cap 300 serves to prevent pressure losses during a drying operation wherein hot air is pumped up through the dye tube subsequent to a dying operation. In particular, cap 300 prevents air from escaping between spindle S and an inner surface of actuator 228. This ensures that the air is pushed through the spindles of material to thus dry the material in an efficient manner. Of course, cap 300 can be omitted from this embodiment or used in combination with the other embodiments discussed above.

Other portions of the third preferred embodiment are similar to the first and second embodiments. In particular, jaws 230 have a tapered lower surface to allow locking assembly 220 to be easily placed over spindle S without being manually set in an unlocked position. Also, the third preferred embodiment can be adapted for use with threaded spindle S' by forming threads on jaws 230 in a manner similar to the second preferred embodiment.

The actuators of the preferred embodiments are substantially cylindrical. However, these actuators may be of any shape which defines an interface surface with the jaws. Also, more than two jaws may be utilized or a single jaw can be utilized. Finally, the jaws may be of any shape which cooperates with the spindle to provide a locking function.

The invention has been described through preferred embodiments. However, those skilled in the art will recognize that various modifications can be made without departing from the scope of the invention, as defined by the appended claims.

What is claimed is:

1. A locking assembly for securing a spool of fibrous material to a spindle during a dyeing operation, said assembly comprising:

a housing;

a pair of jaws mounted in said housing for movement towards and away from each other, said jaws defining a central area therebetween;

means for biasing said jaws towards each other to cause said jaws to engage with the spindle when the spindle is received in the central area; and means for moving said jaws away from each other in response to placement of said assembly over the spindle in order to allow said assembly to be moved, in a first direction, to a desired position on said spindle with a portion of said spindle being received in said central area wherein said jaws are mounted for liner movement in a plane which is perpendicular to an axis of the spindle when the spindle is received in the central area.

2. A locking assembly as claimed in claim 1 wherein said means for moving comprises an angled surface formed on a lower portion of said jaws, said angled surface interacting with the spindle to cause said jaws to move away from each other when said assembly is moved in said first direction along said spindle.

3. A locking assembly as claimed in claim 1 wherein the spindle has threads formed thereon, said assembly further comprising:

a threaded portion formed on each of said jaws, said threaded portion engaging with said threads when said jaws are in a locked position.

4. A locking assembly as claimed in claim 1, further comprising:

a cover disposed over an upper end of said actuator to seal a path defined between said spindle and an inner surface of said actuator when said spindle is received in said central area.

5. A locking assembly for securing a spool of fibrous material to a spindle during a dyeing operation, said assembly comprising:

a housing;

a pair of jaws mounted in said housing for movement towards and away from each other, said jaws defining a central area therebetween;

means for biasing said jaws towards each other to cause said jaws to engage with the spindle when the spindle is received in the central area; and an actuator, said actuator being substantially cylindrical and having openings formed therein, said actuator being rotatably disposed in said housing, said jaws extending through respective ones of said openings, edges of said openings being brought into contact with said jaws to move said jaws to a released position when said actuator is rotated from a first position to a second position.

6. A locking assembly as claimed in claim 5, further comprising:

a cover disposed over an upper end of said actuator to seal a path defined between said spindle and an inner surface of said actuator when said spindle is received in said central area.

7. A locking assembly for securing a spool of fibrous material to a spindle during a dyeing operation, said assembly comprising:

a housing;

a pair of jaws mounted in said housing for movement towards and away from each other, said jaws defining a central area therebetween;

means for biasing said jaws towards each other to cause said jaws to engage with the spindle when the spindle is received in the central area, said jaws being mounted for pivotable movement about an axis which is parallel to an axis of the spindle when the spindle is received in said central area; and means for pivoting said jaws away from each other in response to placement of said assembly over the spindle in order to allow said assembly to be moved, in a first direction, to a desired position on said spindle with a portion of said spindle being received in said central area.

8. A locking assembly for securing a spool of fibrous material to a spindle during a dyeing operation, said assembly comprising:

a housing;

a pair of jaws mounted in said housing for movement towards and away from each other, said jaws defining a central area therebetween;

means for biasing said jaws towards each other to cause said jaws to engage with the spindle when the spindle is received in the central area; and means for moving said jaws away from each other in response to placement of said assembly over the spindle in order to allow said assembly to be moved, in a first direction, to a desired position on said spindle with a portion of said spindle being received in said central area, said means for moving comprising an actuator for allowing said jaws to be moved away from said central area to a released position, said actuator being substantially cylindrical and having openings formed therein, said jaws extending through respective ones of said openings, edges of said openings engaging with said jaws to move said jaws to said released position when said actuator is moved from the first position to a second position.

9. A locking assembly as claimed in claim 8, wherein said actuator is moved linearly from said first position to said second position.

10. A locking assembly as claimed in claim 8, wherein said actuator is rotated from said first position to said second position.

11. A locking assembly for securing a spool of fibrous material to a spindle during a dyeing operation, said assembly comprising:

a housing;

a pair of jaws mounted in said housing for movement towards and away from each other, said jaws defining a central area therebetween;

means for biasing said jaws towards each other to cause said jaws to engage with the spindle when the spindle is received in the central area; and means for moving said jaws away from each other in response to placement of said assembly over the spindle in order to allow said assembly to be moved, in a first direction, to a desired position on said spindle with a portion of said spindle being received in said central area, wherein a beveled surface is formed on a surface of said housing to guide said spindle into said central area and place a substantially flat surface of said housing against an upper end of a dye tube which is placed on said spindle.

12. A locking assembly for securing a spool of fibrous material to a spindle during a dyeing operation, said assembly comprising:

a housing;

a pair of jaws mounted in said housing for movement towards and away from each other, said jaws defining a central area therebetween;

means for biasing said jaws towards each other to cause said jaws to engage with the spindle when the spindle is received in the central area; and an actuator, said actuator being substantially cylindrical and having openings formed therein, said jaws extending through respective ones of said openings, edges of said openings interacting with said jaws to move said jaws to a released position when said actuator is moved from a first position to a second position, wherein a beveled surface is formed on a surface of said housing to guide said spindle into said central area and place a substantially flat surface of said housing against an upper end of a dye tube which is placed on said spindle.

13. A locking assembly for securing a spool of fibrous material to a spindle during a dyeing operation, said assembly comprising:

a housing;

a pair of jaws mounted in said housing for movement towards and away from each other, said jaws defining a central area therebetween;

means for biasing said jaws towards each other to cause said jaws to engage with the spindle when the spindle is received in the central area;

an actuator, said actuator being substantially cylindrical and having openings formed therein, said jaws extending through respective ones of said openings, edges of said openings interacting with said jaws to move said jaws to a released position when said actuator is moved from a first position to a second position; and a cover disposed over an upper end of said actuator to seal a path defined between said spindle and an inner surface of said actuator when said spindle is received in said central area, said cover extending over an upper end of the spindle when the spindle is received in the central area.

14. A locking assembly for securing a spool of fibrous material to a vertically disposed spindle during a dyeing operation, said assembly comprising:

a housing;

locking means disposed in said housing and cooperating with said shaft for permitting the locking assembly to move continuously downward along the spindle due to the weight of the locking assembly until the locking assembly abuts against the spool and for preventing the locking assembly from moving upward along the spindle; and means for releasing said locking means to thereby allow the locking assembly to be moved upward along the shaft.

15. A locking assembly for securing a spool of fibrous material to a spindle during a dyeing operation, said assembly comprising:

a housing;

a pair of jaws mounted in said housing for movement towards and away from each other, said jaws defining a central area therebetween;

means for biasing said jaws towards each other to cause said jaws to engage with the spindle when the spindle is received in the central area; and means for moving said jaws away from each other area in response to the weight of the locking assembly when the locking assembly is placed over the spindle in order to allow said assembly to move downward due to the weight thereof until the locking assembly abuts the spool with a portion of said spindle being received in said central area.

16. A locking assembly as claimed in claim 15 wherein said jaws are pivotable about an axis which is perpendicular to an axis of the spindle when the spindle is received in the central area.

17. A locking assembly for securing a spool of fibrous material to a spindle during a dyeing operation, said assembly comprising:

a housing;

a pair of jaws mounted in said housing, said jaws defining a central area therebetween and being pivotable about an axis which is perpendicular to an axis of the spindle when the spindle is received in the central area, at least a portion of each of said jaws being substantially semicircular, said portions of said jaws each having a notch cut therein, said notch being defined by surface which form substantially a right angle;

means for biasing said jaws towards each other to cause said jaws to engage with the spindle when the spindle is received in the central area; and an actuator for allowing said jaws to be moved away from said central area to a released position, said actuator being substantially cylindrical and having openings formed therein, respective portions of said actuator being received in said notches so that a part of said jaws extends through respective ones of said openings, edges of said openings engaging with said jaws to move said jaws to said released position when said actuator is moved from a first position to a second position.

18. A locking apparatus as claimed in claim 17, further comprising:

means for pivoting said jaws away from each other area in response to placement of said assembly over the spindle in order to allow said assembly to be moved, in a first direction, to a desired position on said spindle with a portion of said spindle being received in said central area.

* * * * *